United States Patent [19]

Cohen

[11] Patent Number: 4,700,843

[45] Date of Patent: Oct. 20, 1987

[54] PIZZA CROWN ASSEMBLY

[76] Inventor: Jerome Cohen, 40 Lee Way, Madison, Conn. 06443

[21] Appl. No.: 878,584

[22] Filed: Jun. 26, 1986

[51] Int. Cl.[4] ..... B65D 85/36

[52] U.S. Cl. ..... 206/521; 206/525; 229/906; 426/106; 426/124

[58] Field of Search ..... 206/45.14, 45.31, 521, 206/525, 588; 229/103, 901, 902, 903, 906; 426/106, 110, 112, 118, 119, 124, 128

[56] References Cited

U.S. PATENT DOCUMENTS

| | | | |
|---|---|---|---|
| 1,939,342 | 12/1933 | Edwards | 426/124 |
| 3,180,739 | 4/1965 | Stoker | 426/124 |
| 3,184,136 | 5/1965 | Forbes, Jr. | 206/588 |
| 3,637,404 | 1/1972 | MacManus | 426/124 |
| 3,866,745 | 2/1975 | Dlugopolski | 206/45.14 |
| 4,228,945 | 10/1980 | Wysocki | 229/903 |
| 4,362,265 | 12/1982 | Williams | 229/901 |
| 4,373,626 | 2/1983 | Roccaforte | 206/45.31 |
| 4,498,586 | 2/1985 | Vitale | 426/124 |

*Primary Examiner*—Jimmy G. Foster

*Attorney, Agent, or Firm*—Bachman & LaPointe

[57] ABSTRACT

A food container fabricated from a one piece paperboard blank suitable for packaging pizza pies and the like where the container includes a tear tab which is convertible into a support for maintaining the integrity of the container.

15 Claims, 5 Drawing Figures

PIZZA CROWN ASSEMBLY

BACKGROUND OF THE INVENTION

The present invention relates to food containers and relates in particular to the packaging of food products such as pies and cakes that have a fairly extensive areal surface that requires protection.

The invention is particularly useful as a container for pizza pies.

In the packaging of food products such as pizza pies, and like food products in "fast food" or "take out" establishments it is important to have a low cost, convenient container which protects the food product especially when loaded containers are stacked upon one another.

When stacked, the crown or central portion of the containers tend to collapse inwardly into contact with the food. This creates an undesirable situation especially when the food product is a hot freshly made pizza whose top dressing usually includes a sauce or melted cheese. The collapsed crown sticks to the top of the pizza making it difficult to separate the cover of the container from the pizza without creating a messy and untidy situation.

Prior art containers have approached this problem by providing a separate plastic or paperboard spacer, separate from and independent of the container, which is positioned upon the food product to keep the crown or central portion of the lid spaced from the surface of the food product.

While these prior art structures have a measure of utility, they have the disadvantages of (1) extra expense, (2) the problem of keeping inventory of containers consistent with inventory of spacers and (3) not being readily at hand at the moment the container is loaded with the food product.

A typical prior art spacer structure which is useful internally or externally of the container is disclosed and described in U.S. Pat. No. 2,975,951 issued Mar. 21, 1961 to W. J. Bosche, Jr. A collar-like structure formed from strips of paperboard includes cleats 25 for connecting the collar to the outside top wall 1 of a food container. Obviously the collar could also be attached to the inside surface of the top wall to support the crown or central portion of the top wall.

SUMMARY OF THE INVENTION

In contrast to the above container structures it is a principal feature of the present invention to provide a food container in the form of a folding carton. The carton is fabricated from a one piece blank of paperboard where the blank includes a detachable spacer or support element as an integral part of the blank and remains an integral part of the container ultimately erected from the blank.

It is a further feature of the invention to provide a one piece paperboard carton blank including a detachable spacer which is economical to fabricate, involves a minimum of scrap and lends itself to high speed mass production procedures.

A further feature of the invention is that the blank from which the package and support element are fabricated is flat, initially, facilitating neat bundling for shipment in commerce.

A further feature of the present invention is the provision of a food container for packaging hot, freshly made food products such as pizza pies where the container in the erect condition includes a detachable spacer readily available to support the central portion or crown of the container top wall keeping the wall free of the surface of the pizza pie.

A folding carton or container fabricated from a one piece paperboard blank suitable for packaging food products such as pizza pies and the like embracing certain fundamentals of the invention may comprise a top wall, a bottom wall, said bottom wall being bounded by opposed sidewalls and opposed endwalls to define an enclosure, said top wall having a plurality of depending flaps operable to be received within said enclosure in telescopic fashion, and, a detachable support element connected to the blank operable to provide structural support between said top and bottom walls.

Other features and advantages of the present invention will become more apparent from an examination of the succeeding specification when read in conjunction with the appended drawings, in which:

DETAILED DESCRIPTION OF THE INVENTION

Figure 2:
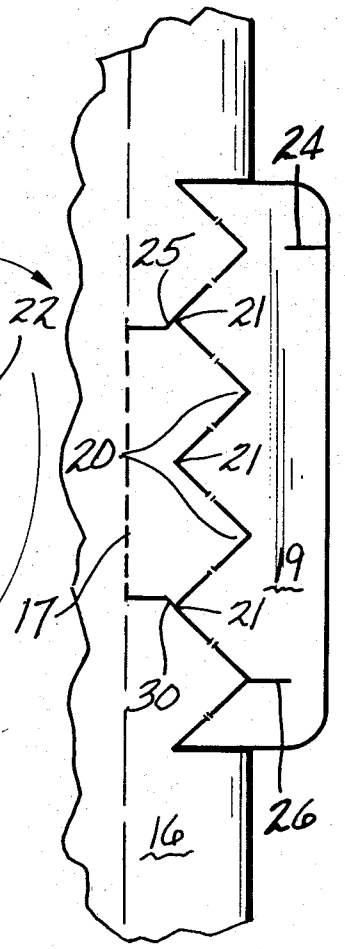
FIG. 2 is a view of a portion of FIG. 1 enlarged to show details of the support element and the locking tongue.
Figure 1:
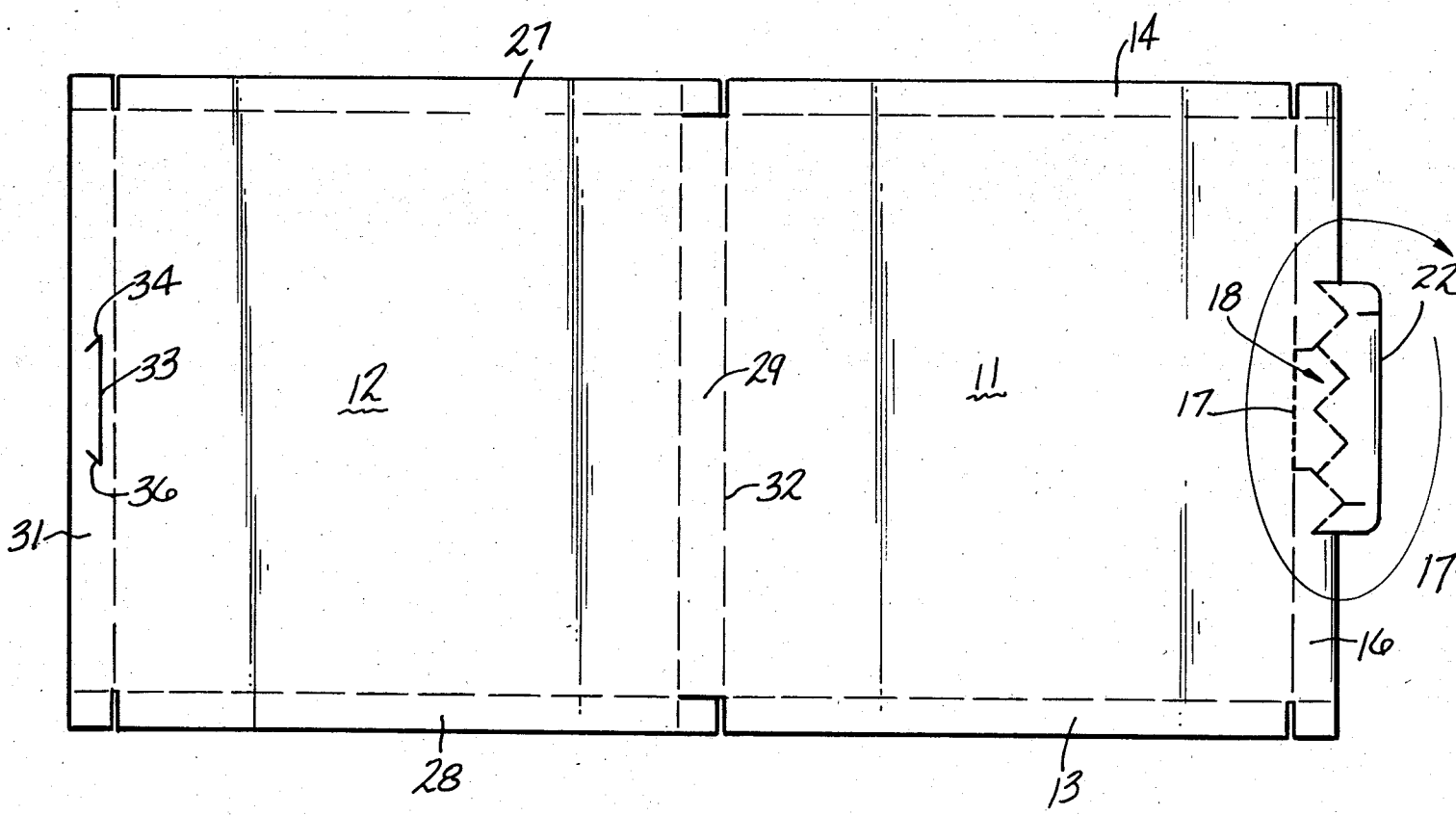
FIG. 1 is a plan view of a one piece blank from which the carton and support element are fabricated.

Referring now in detail to the drawings, a folding carton or container 10 fabricated from a one piece blank of paperboard includes a top wall 11 and a bottom wall 12.

Depending from the top wall 11 are hinged flaps 13, 14 and 16. Central flap 16 is formed with a score or weakened line 17 hinging a locking tongue 18 having teeth 20 to the flap.

The weakened line 17 also facilitates opening the carton lock as will become more apparent hereinafter.

An extension of the flap 16 and the tongue 18 defines a detachable support element or spacer 19.

The support element 19 is generally elongated and has a first margin defining a saw toothed configuration creating a plurality of apices 21—21 and a second margin 22 defining a generally straight line.

The reference numeral 23 defines a line of weakness or a tear line making possible to detach the support element 19 from the locking tongue 18 and from the flap 16.

The support element has opposed through slits 24 and 26 making it possible to form the support element after detachment into a generally circular collar by the engagement of slit 24 with slit 26 in the fashion of the well known egg case divider.

Figure 3:
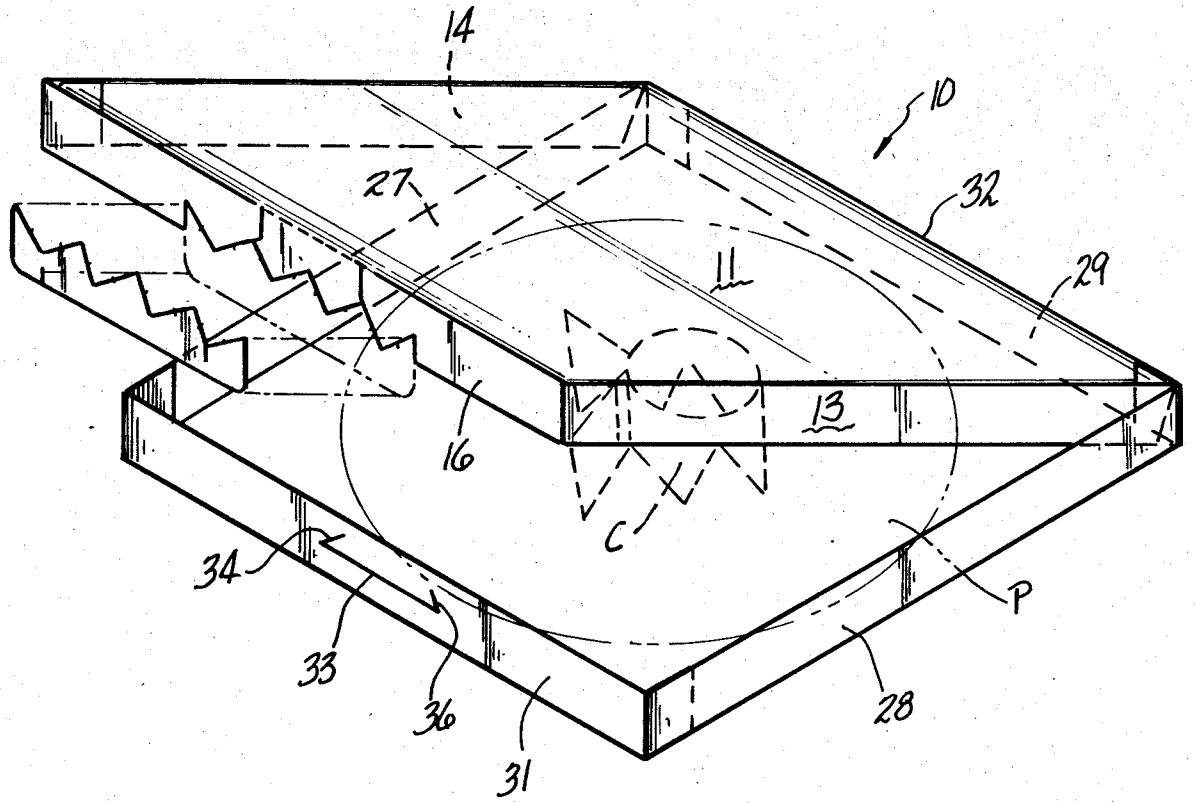
FIG. 3 shows the erected carton with the support element detached and in phantom within a loaded carton.
Figure 4:
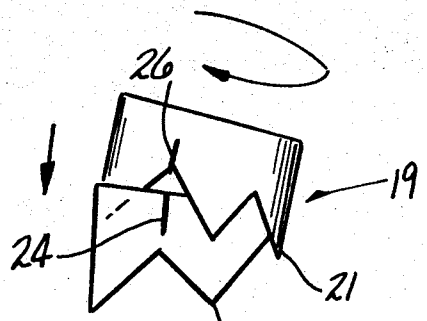
FIGS. 4 and 5 show the steps in erecting the support element.
Figure 5:
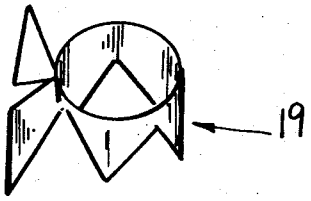

After the support element 19 has been formed (erected) into the collar configuration as shown at C in FIG. 3, the collar is placed upon a fresh, hot, food product such as a pizza pie P with the apices 21—21 engaging the surface of the pie to create a minimum of contact and thus a minimum of disturbance of the surface of the pie.

Correspondingly the second margin 22 or straight edge of the collar is in position to contact and support the top wall of the containers particularly the central portion or crown thereof when the container is closed.

The bottom wall 12 includes opposed side walls 27 and 28 secured to opposed end walls 29 and 31 by usual and customary glue tabs or equivalent connectors (not shown) in well known fashion to create an enclosure.

The top wall is hinged to the end wall 29 by hinge line 32.

The end wall 31 is formed with a through cut 33 terminating in return cuts 34 and 36 to facilitate reception of the teeth 20—20 of locking tongue 18.

Upon closure of the container with the teeth 20—20 inserted in through cut 33, the apices 21—21 of the support element 19 (C in FIG. 3) engage the pie and the margin 22 of the support element 19 (now in the form of a collar) supports the crown of the top wall 11. The return cuts 34 and 35 of end wall 31 interlock with mating locking cuts 25 and 30 in locking tongue 18 to keep the container closed in well known fashion.

In the locked condition of the carton the lock is readily broken by grasping locking cuts 25 or 30 and tearing the tongue free of the flap 16 along the weakened line 17.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed:

1. A folding carton blank including a detachable carton support element defining initially a unitary piece of paperboard for packaging food products such as pizza pies and the like comprising:

a paperboard blank cut and scored to define when erected a closed carton having a top wall and a bottom wall;

said bottom wall being bounded by opposed side walls and opposed end walls to define an enclosure;

said top wall being hinged to one of said end walls and side walls;

said top wall having a plurality of depending flaps operable when said carton is erected to be received within said enclosure in telescopic fashion;

a central portion of said top wall having a tendency to collapse when loaded cartons are stacked vertically;

a detachable carton support element adapted to be formed into a collar connected to the blank by a line of weakness; and, locking means formed on said support element for converting said element into a collar upon detachment;

said collar being operable to provide central structural support between said top and bottom walls when said carton is erected and in the closed condition.

2. The carton blank of claim 1 in which a locking tongue is formed on one side depending flaps and a cooperating locking slot is formed on a mating one of said end walls and side walls.

3. The carton blank of claim 2 in which said support element defines an extension of said locking tongue.

4. The carton blank of claim 3 in which a line of demarcation between said support element and said locking tongue defines a line of weakness.

5. The carton blank of claim 4 in which said line of weakness defines a saw toothed configuration creating a plurality of apices spaced from a generally straight edge.

6. The carton blank of claim 5 in which the support element defines an elongated, generally planar piece part having opposed, cooperating locking slits facilitating converting said elongated piecepart into an endless, arcuate configuration.

7. The carton blank of claim 1 in which a locking slot is formed on one of said depending flaps and a cooperating locking tongue is formed on a mating one of said end walls and side walls.

8. The carton blank of claim 7 in which said support element defines an extension of said locking tongue.

9. The carton blank of claim 8 in which a line of demarcation between said support element and said locking tongue defines a line of weakness.

10. The carton blank of claim 9 in which said line of weakness defines a saw toothed configuration creating a plurality of apices spaced from a generally straight edge.

11. The carton blank of claim 10 in which the support element defines an elongated, generally planar piece part having opposed, cooperating locking slits facilitating converting said elongated piece part into an endless, arcuate configuration.

12. In a paperboard container having a top wall and a bottom wall including telescoping side walls with a food product disposed in said container upon said bottom wall, the improvement comprising:

a detachable element adapted to be formed into a collar having opposed ends connected to said container and defining with said container a single structure, locking means incorporated in said opposed ends for connecting said ends to develop a collar, said element being operable upon detachment from said container and upon formation of said collar to be disposed centrally of said container upon said food product to maintain spacing between the surface of the food product and said top wall and to support said top wall.

13. The container of claim 12 in which the support element is formed with a first margin defining a plurality of apices and a second margin defining a generally straight line and the apices are operable to contact the food product and the second margin is operable to contact the top wall.

14. The container of claim 12 in which the top and bottom walls are hinged and the telescoping side walls include a locking tongue and a cooperating locking slot for maintaining a closed position of said container.

15. The container of claim 12 in which the locking tongue is connected by a line of weakness to facilitate unlocking the telescoping side walls.

* * * * *